United States Patent [19]

Owen et al.

[11] Patent Number: 4,678,014

[45] Date of Patent: Jul. 7, 1987

[54] INFLATOR/DEFLATOR WITH MOLDED HOUSING

[75] Inventors: Charles B. Owen, Long Grove; Charles C. Owen, Chicago, both of Ill.; Steve Lin, Taipei, Taiwan

[73] Assignee: Siesta Corporation, Northbrook, Ill.

[21] Appl. No.: 845,483

[22] Filed: Mar. 27, 1986

Related U.S. Application Data

[63] Continuation-in-part of Ser. No. 668,518, Nov. 5, 1984, abandoned.

[51] Int. Cl.[4] ..... B65B 3/14

[52] U.S. Cl. ..... 141/67; 141/98; 141/350; 141/363; 5/453; 417/360; 417/361

[58] Field of Search ..... 141/38, 98, 1-12, 141/65, 66, 67, 346-350, 363-366; 417/234, 238, 360, 361, 423; 446/222; 5/453, 449; 222/3; 137/231, 233; 220/22.3, 4 B, 408, 410; 152/415

[56] References Cited

U.S. PATENT DOCUMENTS

| | | | |
|---|---|---|---|
| 2,547,761 | 4/1951 | Korte | 417/361 |
| 2,944,694 | 7/1960 | Kinsey | 220/408 |
| 3,275,180 | 9/1966 | Optner | 220/410 |
| 3,389,133 | 6/1967 | Oberst | 220/22.3 |
| 3,400,809 | 9/1968 | Puente | 220/408 |
| 4,436,215 | 3/1984 | Kleinert et al. | 220/22.3 |

*Primary Examiner*—Houston S. Bell, Jr.

*Attorney, Agent, or Firm*—Dressler, Goldsmith, Shore, Sutker & Milnamow, Ltd.

[57] ABSTRACT

A hand-holdable inflatable/deflating device is disclosed which can be used for conveniently effecting inflation or deflation of an associated article. The inflator includes an electric motor which drives a centrifugal impeller, with the motor and impeller carried by a mounting frame. The device further includes a generally cylindrical housing within which the motor and impeller are positioned, whereby operation of the motor rotates the impeller to create axial airflow within the housing. Significantly, the housing of the device comprises a one-piece injection molding, with the housing specifically configured to promote highly efficient assembly with the other components of the device. Further, a detachable, reversibly positionable nozzle is provided which can be fitted to either end of the molded housing, thus facilitating use of the device for either inflation or deflation. The nozzle can be configured to include an integral projection which is engageable with a safety valve of an associated inflatable article for opening the safety valve.

4 Claims, 8 Drawing Figures

INFLATOR/DEFLATOR WITH MOLDED HOUSING

CROSS-REFERENCE TO RELATED APPLICATION

The present application is a continuation-in-part of U.S. application Ser. No. 668,518, filed Nov. 5, 1984, now abndoned.

TECHNICAL FIELD

The present invention relates generally to an electrically-powered, hand-holdable device for inflating and deflating an associated inflatable article, and more particularly to an inflating and deflating device having a one-piece molded plastic housing which promotes economical fabrication and assembly of the device, and including a reversibly positionable nozzle which can be configured for self-actuation of an associated safety valve structure.

BACKGROUND OF THE INVENTION

Inflatable articles such as air mattresses, chairs, and like articles of furniture have become increasingly popular for use in the home since such articles can be conveniently inflated for use and compactly stored in a deflated condition. For example, air matresses have become increasingly sophisticated in design for enhanced comfort, and thus provide a convenient means for accommodating house guests. Not only are such inflatable articles quite versatile, they are also relatively economical, and thus have proven quite popular with consumers.

Naturally, convenient use of such inflatable articles calls for an arrangement for easily and efficiently effecting inflation and deflation of such devices. To this end, electrically-powered inflating and deflating devices are known, but have suffered from distinct drawbacks in design. For example, one typical inflating device includes a cylindrical steel housing which houses an electric motor and associated impeller, with a pair of nozzles provided at respective opposite ends of the housing for connecting the device to an inflatable article. Not only does the fabrication of the housing from steel add to the manufacturing cost and weight of the device, the electrically conductive nature of the housing undesirably poses a potential for electrical shock to a user should the device malfunction.

Additionally, fabrication of the housing from steel significantly complicates assembly of the device since suitable mounting holes must be formed in the housing for receiving fasteners to secure the motor and impeller assembly therein. Since the interior of the housing is typically formed with a generally smooth surface, manufacture of the device is further complicated since the motor and impeller assembly must be very carefully positioned within the housing for effecting the desired securement therein. The provision of a pair of nozzles at opposite ends of the housing further adds to manufacturing costs, with assembly further complicated by the desired provision of a handle which must be joined to the housing with fasteners to facilitate holding the device.

In view of the foregoing, it will be appreciated that it is highly desirable to provide an inflating and deflating device which is configured for economical fabrication, thus promoting affordable use by consumers. The inflator/deflator of the present invention has been particularly configured for highly efficient and economical manufacture, as well as for convenient use.

SUMMARY OF THE INVENTION

In accordance with the present invention, an inflating and deflating device is disclosed which has been particularly configured for efficient manufacture and convenient consumer use. To this end, the device includes a one-piece injection molded plastic housing which is constructed to facilitate efficient assembly with other components of the device. Manufacture of the housing from injection molded plastic is not only desirably less expensive than use of a comparable steel housing, but further permits integral formation of various elements on the housing itself to promote efficient assembly with other components of the device. Further, manufacture of the housing from electrically non-conductive plastic material substantially eliminates the risk of electrical shock to a user in the event of malfunction.

The inflating and deflating device of the present invention includes an electric motor, and a centrifugal impeller which is driven by the electric motor. The device further includes a preferably generally rectangular mounting frame which is secured to the electric motor, with the mounting frame including a pair of opposed side frame portions which are positioned generally at respective opposite sides of the motor.

The present inflating and deflating device further includes a generally cylindrical, unitary or one-piece injection molded housing within which the motor, the impeller, and the mounting frame are positionable as a unit. When assembled, operation of the electric motor rotates the impeller to create airflow axially through the housing for effecting inflation and deflation of an associated inflatable article. In the preferred embodiment, the molded housing includes an integrally formed handle to facilitate holding the device, and an integrally formed end wall positioned adjacent to the impeller, with the end wall defining a plurality of centrally disposed air inlets for effecting airflow into the impeller.

Significantly, assembly of the present device is facilitated by the formation of integral channels on the interior of the housing for receiving the mounting frame which carries the motor and impeller. Specifically, the molded housing is formed with two opposed pairs of channel projections, with each pair of projections defining a channel configured to receive a respective one of the side frame portions of the mounting frame. By this arrangement, the pre-assembled motor, impeller, and mounting frame can be very easily slid into the molded housing, thus promoting highly efficient assembly of the device. Reduction of labor is desirably achieved, resulting in significant assembly cost savings.

In the preferred embodiment, the molded housing is further provided with a pair of integrally formed stop projections on the interior thereof which are respectively engagable with the side frame portions of the mounting frame. The stop projections are respectively positioned at an end of each of the mounting channels defined within the housing, with the side frame portions of the mounting frame respectively engaging the stop projections as the device is assembled to effect the desired relative axial positioning of the electric motor and its impeller relative to the housing. A pair of lock members can thereafter be secured to the housing for engagement with the mounting frame to lock the mounting frame, and thus the motor and impeller, in position within the housing.

Economical manufacture of the present device is further facilitated by the provision of a nozzle member which can be selectively removably secured to either axial end of the molded housing. To this end, the molded housing preferably includes integrally molded external threads at each opposite end of the housing. By this construction, the nozzle can be removably secured to one end of the housing for effecting inflation of an associated inflatable article, and can be removably secured to the other end of the housing for effecting deflation of the article.

In one illustrated embodiment, the reversibly positionable nozzle is configured for self-actuation of a safety valve portion of a fill valve construction of an inflatable article. Such a safety valve typically comprises a flap-like member positioned within the fill valve construction. In order to urge the safety valve member to an open position, the nozzle of the inflator is provided with an integral valve-engaging projection which urges the safety valve open. Convenient inflation and deflation of the article are thus promoted.

Other features and advantages of the present invention will become readily apparent from the following detailed description, the accompanying drawings, and the appended claims.

DETAILED DESCRIPTION

Figure 1:
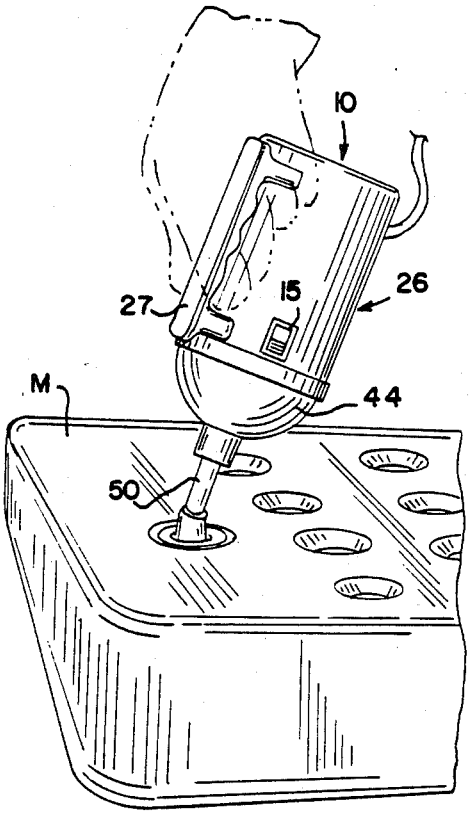
FIG. 1 is a perspective view illustrating an inflating and deflating device embodying the principles of the present invention in use with an associated inflatable article.

While the present invention is susceptible of embodiment in various forms, there is shown in the drawings and will hereinafter be described a presently preferred embodiments, with the understanding that the present disclosure is to be considered as an exemplification of the invention, and is not intended to limit the invention to the specific embodiments illustrated.

With reference first to FIG. 1, therein is illustrated a combination inflating/deflating device 10 embodying the principles of the present invention. Inflator 10 is shown being used to inflate an associated inflatable article, illustrated as air mattress M. As will be further described, inflator 10 is suited for use to both inflate and deflate a wide variety of different inflatable articles.

Figure 2:
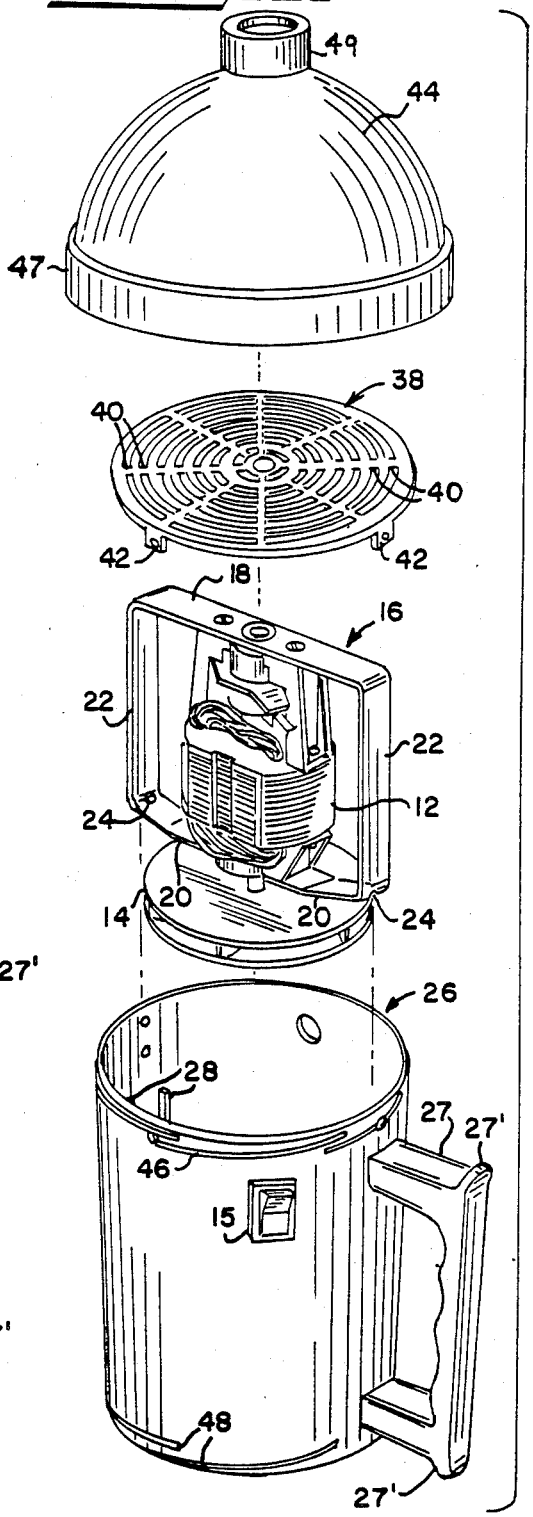
FIG. 2 is an exploded perspective view of the inflating and deflating device shown in FIG. 1.
Figure 3:
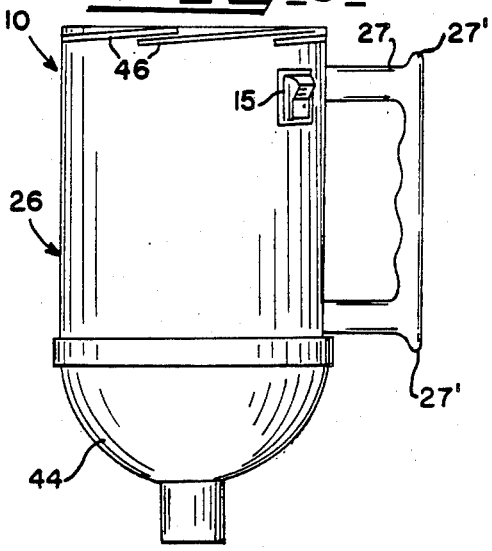
FIG. 3 is a side elevational view of the present device in its configuration for effecting deflation of an associated article.
Figure 4:
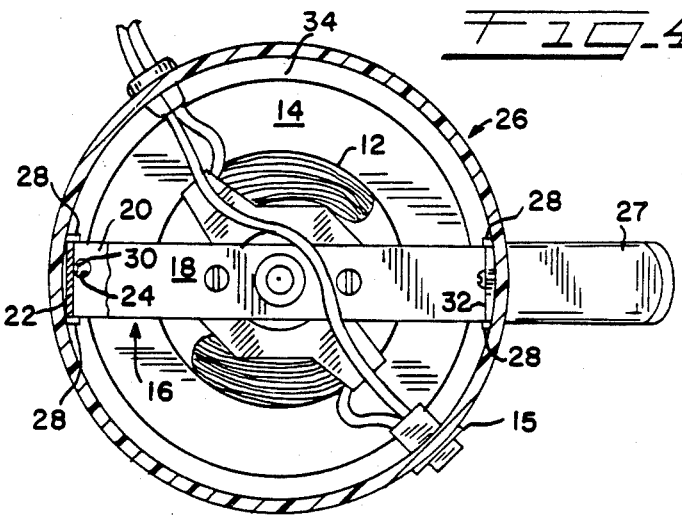
FIG. 4 is a cross-sectional end axial view of the present inflating device.
Figure 5:
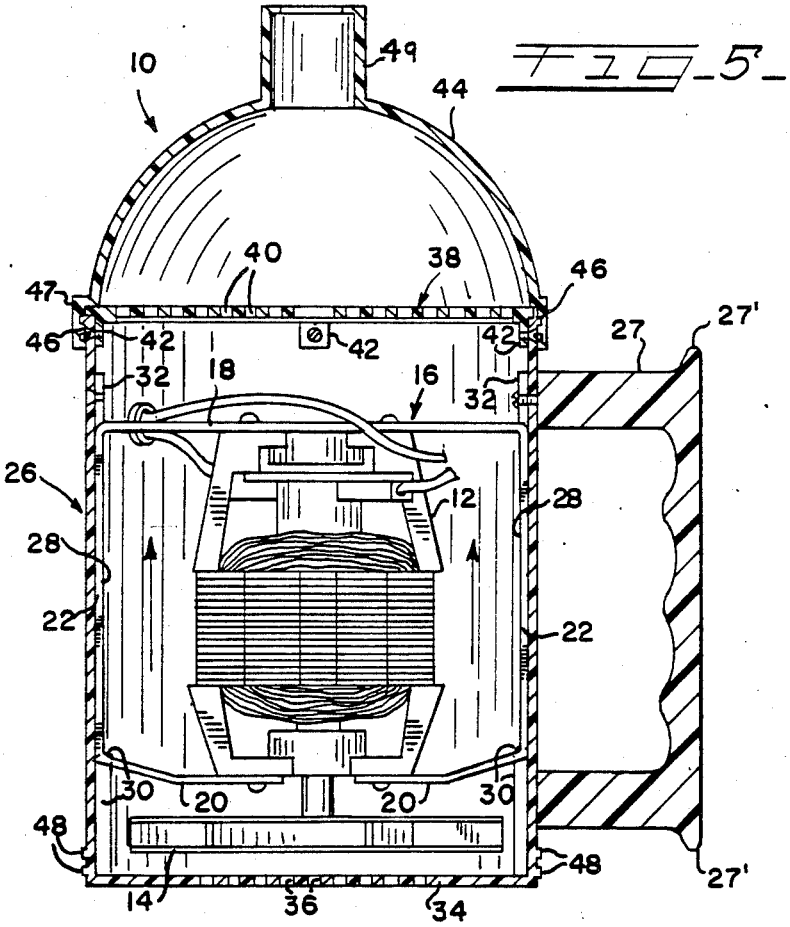
FIG. 5 is a cross-sectional side elevational view of the present inflating device.

Referring particularly to FIGS. 2, 4, and 5, inflator 10 includes an electric motor 12 which drives a centrifugal impeller 14. A switch 15 is preferably provided for selective operation of motor 12. For versatility of use, electric motor 12 can be wired for operation by standard household alternating current, or may be suitably wired for 12-volt direct current operation, such as from a car or boat battery.

In the preferred form, the motor 12 and impeller 14 comprise part of a "pre-assembly", which further includes a generally rectangular mounting frame 16. Mounting frame 16 includes opposite end frame portions 18 and 20 respectively secured to motor 12, and further includes a pair of opposed side frame portions 22 extending between the end frame portions. Notably, mounting frame 16 preferably defines a pair of stop openings 24 (see FIG. 2) which are respectively positioned generally at the ends of side frame portions 22 at the junctions of the side frame portions and end frame portions 20. As will be further described, these stop openings are preferably provided to facilitate efficient assembly of inflator 10.

In accordance with the present invention, inflator 10 includes a generally cylindrical, injection molded plastic housing 26 within which motor 12 and impeller 14 are positioned. Operation of motor 12 acts to rotate impeller 14 to create airflow axially through housing 26 in the direction indicated by the arrows in FIG. 5. Housing 26 has been specifically configured for efficient and economical fabrication as a one-piece, unitary molding, and has further been configured to promote efficient assembly with the other components of inflator 10. The exterior of housing 26 is preferably provided with an integral handle 27 so that the inflator can be conveniently hand-held. Handle 27 is preferably provided with molded extensions 27' to facilitate winding or wrapping of the device's electrical supply cord about the handle for storage Notably, formation of housing 26 from electrically non-conductive plastic material desirably enhances the safety of the present inflator since the risk of electrical shock to a user in event of malfunction is substantially eliminated.

In order to promote efficient final assembly of inflator 10, housing 26 includes integrally molded means for receiving the motor frame 16 such that motor 12 and impeller 14 are automatically positioned in the desired relative radial and axial positioning relative to the housing. To this end, the interior of housing 26 includes first and second pairs of channel projections 28, with the two pairs of projections defining respective, diametrically opposed channels which respectively receive the side frame portions 22 of the motor frames 16. Thus, during assembly of inflator 10, and as illustrated in FIG. 2, the "pre-assembled" motor 12, impeller 14, and mounting frame 16 can be very easily slid axially into position within the housing 26.

In the preferred form, the housing 26 further includes stop means engagable with the motor frame 16 when the frame is received within the opposed channels within the housing for effecting the desired relative axial positioning of the motor and the impeller within the housing. In the illustrated embodiment, such stop means are provided in the form of a pair of integrally formed stop projections 30 on the interior of the housing. The stop projections 30 are respectively positioned at an end of each of the opposed channels (defined by projections 28) within the housing, and are configured to respectively engage the side frame portions 22 of mounting frame 16. To this end, the aforesaid stop openings 24 defined by mounting frame 16 are respectively alignable with the stop projections 30 such that the stop projections are respectively received within the stop openings 24 for engagement with side frame portions 22 (FIG. 5).

In order to lock mounting frame 16 (and motor 12 and impeller 14) in position within housing 26 after the mounting frame has been slid into the opposed interior channels and has engaged stop projections 30, a pair of lock members 32 are provided (FIG. 5) which are positionable in engagement with mounting frame 16 to lock the mounting frame in position within the interior channels of housing 26. Lock members 32 may be secured in position within the housing by suitable mechanical fasteners as shown, or by suitable adhesive or the like.

As will be appreciated, the above-described arrangement promotes highly efficient assembly of inflator 10, since installation of motor 12 and impeller 14 within housing 26 is effected by merely sliding mounting frame 16 into housing 26, and thereafter locking the mounting frame into the housing by securing lock members 32 in position.

In the illustrated embodiment, housing 26 of inflator 10 includes an integrally formed perforate end wall 34 positioned adjacent to impeller 14. End wall 34 defines a plurality of centrally disposed air inlets 36 for effecting airflow into the central portion of impeller 14, with the impeller accelerating the air for creating the desired axial airflow within housing 26. Since air flows within the housing about motor 12, the motor is desirably cooled for long and dependable service.

In order to close housing 26 after the motor and impeller assembly has been positioned therein, inflator 10 includes a perforate, molded plastic outlet plate 38 which is secured to the end of housing 26 opposite end wall 34. Outlet plate 38 defines a plurality of air outlets 40 through which air flows from housing 26, with the outlet plate 38 preferably including a plurality of integrally formed mounting tabs 42 so that the outlet plate can be easily secured to the housing with suitable mechanical fasteners or the like.

After the motor and impeller assembly has been positioned within housing 26, and outlet plate 38 affixed thereto, inflator 10 appears as a generally closed-ended cylinder, with air inlets 36 at one end and air outlets 40 at the other. With this configuration of the inflator 10 in mind, it will be appreciated that suitable direction of the airflow from outlets 40 permits inflation of an associated article such as mattress M, while suitable direction of airflow into air inlets 36 permits deflation of an article.

Accordingly, inflator 10 includes a generally tapered nozzle 44 which is configured for detachable connection to the associated inflatable article. Significantly, inflator 10 is configured such that nozzle 44 can be removably secured to either end of housing 26, thus permitting the same nozzle 44 to be used for either inflation or deflation of articles. This feature of the present invention further helps to reduce its manufacturing costs, since unlike previous inflating/deflating devices, the present inflator need only include a single nozzle 44. The provision of perforate end wall 34 and perforate outlet plate 38 prevent accidental insertion of a finger into housing 26 regardless of the positioning of nozzle 44.

In keeping with the desired goals of economical manufacture and convenient use, housing 26 is provided with integrally formed means for removably securing the nozzle 44 to either end of the housing. More specifically, the exterior of housing 26 defines a first set of integrally formed male mount threads 46 at one end of the housing, and a second set of integrally formed male mount threads 48 at the opposite end of the housing. By providing the nozzle 44 with suitable mating female threads on an internally threaded annular portion 47 of the nozzle, nozzle 44 can be very easily removably secured to mount threads 46 when the inflator 10 is to be used for inflation of an article, with the nozzle 44 being conveniently switched to the opposite end of the housing and mounted on mount threads 48 when the device is to be used for deflating an article. If desired, a tapered adapter 50 (FIG. 1) can be provided which removably fits within a connector portion 49 of nozzle 44 so that the nozzle can readily be connected to a wide variety of different inflatable articles.

Figure 6:
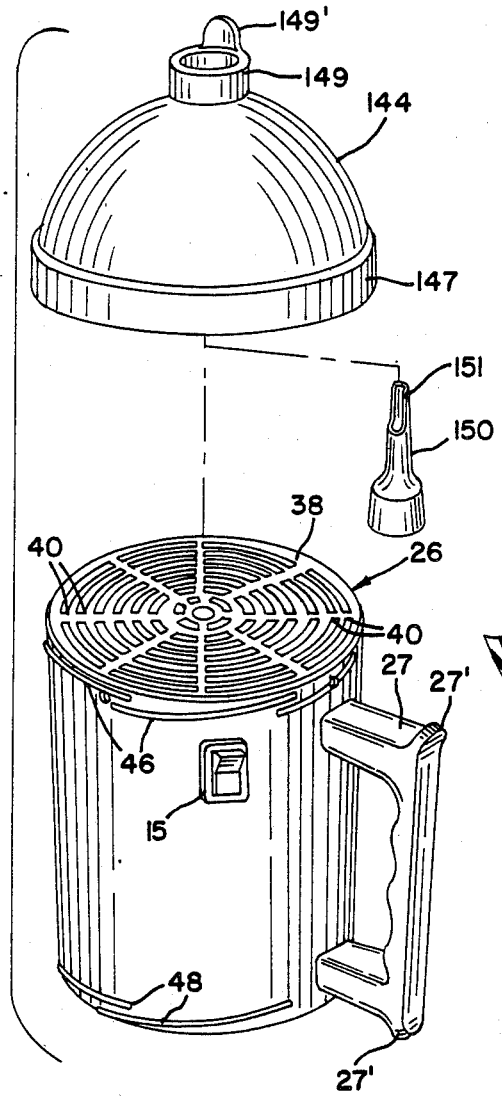
FIG. 6 is a partially exploded perspective view similar to FIG. 2 illustrating an alternate embodiment of a nozzle portion of the present inflating and deflating device.
Figure 7:
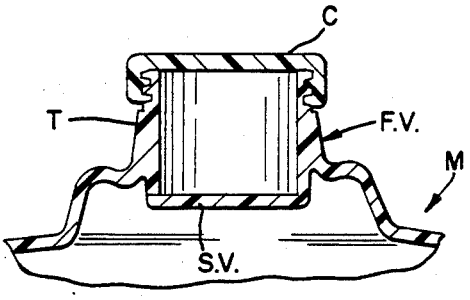
FIG. 7 is a cross-sectional view of a fill valve construction, including a movable safety valve member, of an inflatable article.
Figure 8:
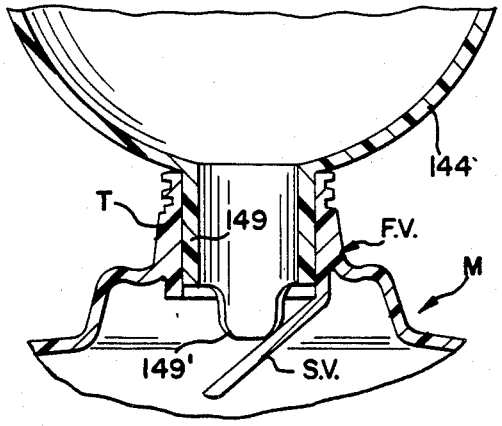
FIG. 8 is a cross-sectional view of the fill valve construction of FIG. 7 illustrating operation of the safety valve thereof by the alternate embodiment of the nozzle portion of the present device.

Referring now to FIGS. 6 through 8, therein is illustrated a modified embodiment of the present inflating-/deflating device, including a reversibly positionable, detachable nozzle 144, including an annular, internally threaded portion 147 and a connector portion 149 adapted for detachable connection with an associated inflatable article. As in the previous embodiment, nozzle 144 can be detachably secured to either end of molded housing 26 by integrally formed threads 46 (for inflation) and by integrally formed threads 48 (for deflation).

Notably, nozzle 144 has been particularly configured to facilitate use of the present inflating device with an associated inflatable article having a safety-type fill valve construction. This type of fill valve construction is shown in FIG. 7, wherein an inflatable article designated M includes a fill valve construction designated F.V. The fill valve construction includes an externally threaded tubular portion T which is configured to receive the connector portion 149 of nozzle 144. An internally threaded removable cap C is ordinarily fitted to the tubular portion T.

In order to avoid inadvertent escape of air from within the inflatable article, fill valve construction F.V. includes a hingedly movable safety valve S.V. comprising a flap-like member joined to the lower extent of tubular portion T by an integral "living" hinge. The configuration of the fill valve is such that safety valve S.V. is ordinarily urged toward its closed disposition, which is shown in FIG. 7.

In the past, opening of the safety valve member has ordinarily been effected by manually squeezing and otherwise manipulating the relatively pliable fill valve construction so that the safety valve S.V. is urged away from its cooperating valve seat provided by the lower extent of tubular portion T. As will be appreciated, movement of the safety valve to its open position not only facilitates inflation of the associated article, but is necessary to facilitate free air flow from the article for effecting deflation thereof.

While opening of safety valve S.V. by suitable manipulation of the fill valve construction is by no means difficult, such suitable manipulation together with hand-held use of the present inflating device, can be inconvenient. Accordingly, nozzle 144 is configured for effecting self-actuation of the movable safety valve member S.V.

To this end, the connector portion 149 of the nozzle 144 has provided thereon a valve-engaging projection 149' which is configured to engage and move the safety valve member S.V. attendant to insertion of connector portion 149 into the tubular portion T of the fill valve construction of an inflatable article. The cooperation of the projection 149' with the safety valve member is illustrated in FIG. 8, wherein it will be observed that the safety valve member is moved away from its mating valve seat, and is positioned such that free flow of air into or from the inflatable article is promoted. In the preferred form, the projection 149' has a cross-sectional configuration generally conforming to a cross-sectional portion of the tubular connector portion 149, thus promoting free air flow. The projection 149' preferably is configured generally as an extension of the outer surface of connector portion 149, thus facilitating insertion into tubular portion T of the fill valve construction F.V., as illustrated in FIG. 8.

Versatile use of the present inflating device is promoted by the provision of an adapter which permits use of the inflator with inflatable articles having a fill valve construction of a relatively small size which does not facilitate the desired cooperating fit with connector portion 149 of nozzle 144. To this end, an adapter 150 is provided which can be fitted within connector portion 149 of nozzle 144 so that the adapter projects from the connector portion 149. In accordance with the present construction, adapter 150 is also provided with a valve-engaging projection 151 for operative engagement with the movable safety valve member of a relatively small fill valve construction. Like the previously-described projection 149', projection 151 preferably generally comprises an extension of the tubular portion of adapter 150, which in the illustrated embodiment is generally conic or tapered.

As will be appreciated, the provision of a valve-engaging projection on the nozzle 144 (or adapter 150) not only promotes convenient use of the present apparatus for effecting inflation of an article, but very desirably promotes convenient use for deflation, which such use is accommodated by the provision of mounting threads 46 and 48 on opposite ends of molded housing 26 for removably receiving the nozzle of the device.

Thus, an inflating/deflating device has been disclosed which has been particularly configured for economical and efficient fabrication, thus promoting affordable use by consumers. As will be recognized, formation of housing 26 of the inflating device from injection molded plastic not only facilitates economical fabrication of the housing, but further permits the housing to be very easily formed with integral channel projections 28 and integral stop projections 30, both of which promote efficient assembly. Similarly, the housing can be readily provided with two sets of mount threads 46 and 48 for removably securing nozzles 44 and 144 to either selected end of the housing, with integral handle 27 provided to facilitate convenient holding and manipulation of the device during use. When compared with previous inflating devices having steel housings, these features of the present invention very significantly promote efficient manufacture of the inflating device, thus substantially reducing the relative assembly costs of the device.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. It is, of course, intended to cover by the appended claims all such modifications as fall within the scope of the claims.

What is claimed is:

1. A hand-holdable device for inflating and deflating inflatable articles, comprising:

an electric motor;

impeller means, for propelling air, secured to and rotatably driven by said electirc motor;

a generally rectangular mounting frame secured to said electric motor for effecting mounting thereof, said mounting frame including opposite end frame portions respectively secured to said motor, and a pair of opposed side frame portions extending in parallel relationship to each other between said end frame portions, said mounting frame defining a pair of stop openings respectively positioned at an end of each said side frame portions generally at the junction thereof with one of said end frame portions;

a generally cylindrical, one-piece injection molded plastic housing having an integral, perforate end wall defining a plurality of air inlets, and an open end opposite said perforate end wall, said electric motor, said impeller means, and said mounting frame being positionable within said molded housing so that operation of said electric motor rotates said impeller means to create air flow axially through said housing for effecting inflation of an associated inflatable article, said mounting frame facilitating positioning of said mounting frame, said electric motor, and said impeller means in said molded housing, as an integated pre-assembled unit, by insertion into said housing through said open end thereof;

said molded housing including integrally formed channel means for receiving said mounting frame comprising a pair of opposed channels arranged in parallel relationship to each other on the interior of said molded housing, each said channel being defined by a respective pair of spaced apart, parallel channel projections, said channels being configured to respectively receive said parallel side frame portions of said mounting frame to facilitate mounting of said electric motor and said impeller means within said housing, said molded housing further including integrally formed stop means on the interior thereof comprising a pair of stop projections respectively positioned at an end of each of said opposed channels, said stop projections being positioned generally adjacent said perforate end wall of said housing, said stop projections respectively engaging said side frame portion of said mounting frame by respective disposition within said stop openings when said mounting frame is inserted through said open end of said housing and received by said channel means for effecting the desired relative axial positioning of said motor and said impeller means within said housing, locking means positioned within said housing in operative engagement with said mounting frame for locking said mounting frame in position within said opposed channel to maintain said relative axial positioning of said electric motor and said impeller means within said housing;

a perforate end plate secured to said molded housing at said open end thereof, said perforate end plate defining a plurality of air outlets for accommodating said airflow axially through said housing; and nozzle means adapted to be secured to said housing so that air flowing through said housing flows through said nozzle means, said nozzle means being adapted for detachable connection to said associated inflatable article, said housing including integrally molded thread means for removably securing said nozzle means on either opposite end of said housing, whereby said nozzle means can be secured to one end of said housing for effecting inflation of said associated inflatable article, and can be secured to the other end of said housing for effecting deflation of said associated inflatable article.

2. An inflating device in accordance with claim 1, wherein said nozzle means includes integral valve-engaging projection means provided on a connector portion thereof, said projection means being engageable with a hingedly movable safety valve member of the associated inflatable article when said nozzle means is detachable connected thereto.

3. An inflating and deflating device in accordance with claim 1, wherein said locking means comprises a pair of lock members positioned within said molded housing in respective engagement with said frame portions at the ends thereof opposite said top openings.

4. An inflating and deflating device in accordance with claim 3, wherein said molded housing includes an integrally formed handle to facilitate holding of said inflating and deflating device, said handle including a pair of spaced apart molded extensions to facilitate winding of an electrical supply cord about said handle.

* * * * *

UNITED STATES PATENT AND TRADEMARK OFFICE

CERTIFICATE OF CORRECTION

PATENT NO. : 4,678,014

DATED : July 7, 1987

INVENTOR(S) : Charles B. Owen, Charles C. Owen and Steve Lin

It is certified that error appears in the above-identified patent and that said Letters Patent is hereby corrected as shown below:

In the Abstract, the word "inflatable" should be "inflating";

In column 8, line 56, the word "portion" should be "portions";

In column 10, line 11, after the word "said" insert --side--.

Signed and Sealed this

First Day of December, 1987

*Attest:*

DONALD J. QUIGG

*Attesting Officer*

*Commissioner of Patents and Trademarks*